US005383321A

United States Patent [19]

Krogman et al.

[11] Patent Number: 5,383,321

[45] Date of Patent: Jan. 24, 1995

[54] MACHINE FOR APPLYING CARRIER STOCK TO CONTAINERS, SUCH AS BEVERAGE CANS, SELECTIVELY IN RIM-APPLIED OR SIDE-APPLIED CARRIER POSITION

[75] Inventors: Stanely R. Krogman, Bartlett; Kevin D. Moore, Hoopeston, both of Ill.

[73] Assignee: Illinois Tool Works Inc., Glenview, Ill.

[21] Appl. No.: 80,571

[22] Filed: Jun. 21, 1993

[51] Int. Cl.[6] ..... B65B 27/04; B65B 53/00

[52] U.S. Cl. ..... 53/48.4; 53/48.5; 53/585; 53/556; 53/201

[58] Field of Search ..... 53/48.3, 48.4, 48.5, 53/556, 585, 398, 201

[56] References Cited

U.S. PATENT DOCUMENTS

| | | | |
|---|---|---|---|
| 4,250,682 | 2/1981 | Braun . | |
| 4,953,342 | 9/1990 | Hynes | 53/398 |
| 5,088,269 | 2/1992 | Thelen | 53/556 X |
| 5,117,609 | 6/1992 | Seymour et al. | 53/48.4 X |
| 5,233,811 | 8/1993 | Odum et al. | 53/48.4 |

*Primary Examiner*—Linda B. Johnson

*Attorney, Agent, or Firm*—Dressler, Goldsmith, Shore & Milnamow, Ltd.

[57] ABSTRACT

Improvements are disclosed in a machine for applying carrier stock of resilient polymeric material to substantially identical containers, each having an upper rim of a given diameter and a side wall of a larger diameter. The carrier stock has container-receiving apertures in longitudinal rows. A conveyor conveys the containers in longitudinal rows. A wheel assembly comprising two wheels with paired jaws receives the stock, stretches the stock transversely, and moves the stock downwardly past the rims. The conveyor, the wheel assembly, and the jaws on one wheel are adjustable for applying the stock selectively in a rim-applied carrier position or in a side-applied carrier position. The conveyor is supported by a table and is adjustable vertically, via spacers insertable between the table and a base. The wheel assembly is adjustable longitudinally, via rollers on longitudinal rails. The jaws on one wheel are adjustable transversely, via screws.

9 Claims, 9 Drawing Sheets

Fig. 6
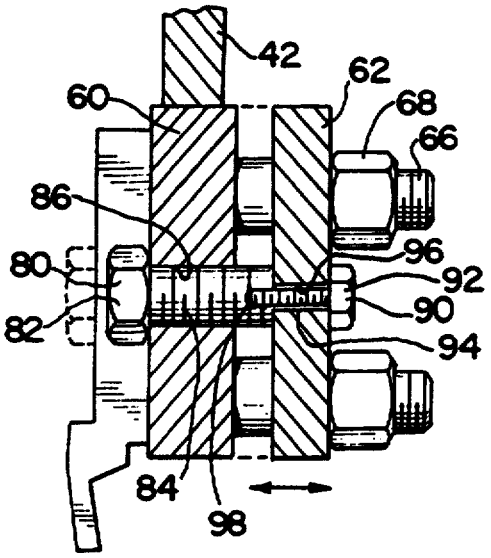
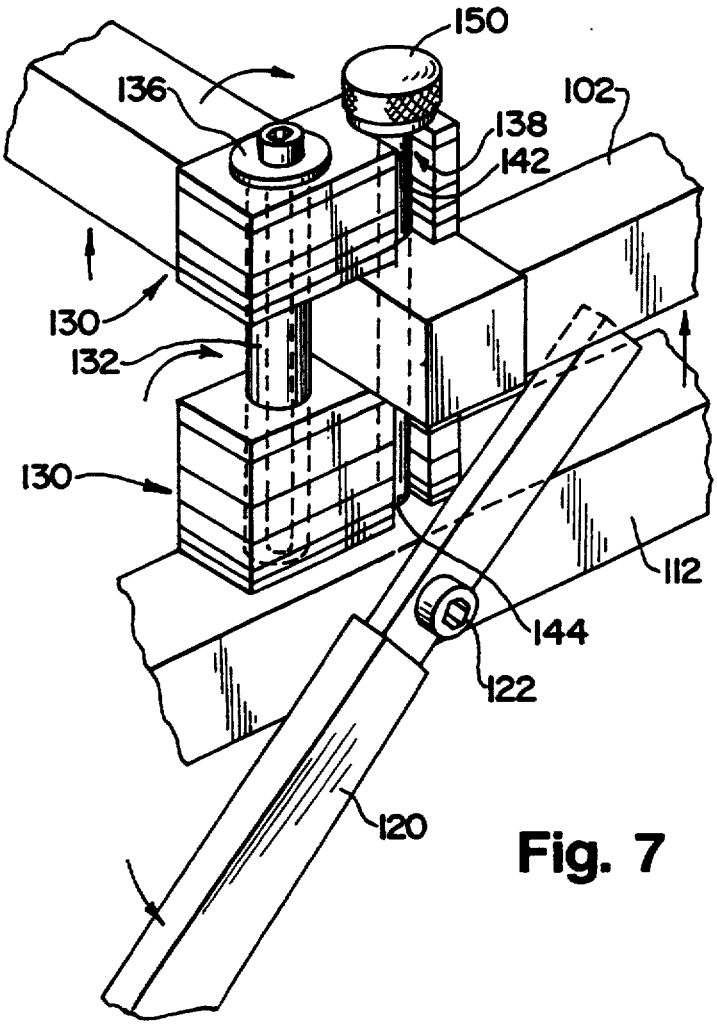
Fig. 7

MACHINE FOR APPLYING CARRIER STOCK TO CONTAINERS, SUCH AS BEVERAGE CANS, SELECTIVELY IN RIM-APPLIED OR SIDE-APPLIED CARRIER POSITION

TECHNICAL FIELD OF THE INVENTION

This invention pertains to an improved machine for applying carrier stock to substantially identical containers, such as beverage cans, of a type having an upper rim of a given diameter and a side wall of a larger diameter. The improved machine can be selectively adjusted for applying the carrier stock to the containers in a rim-applied carrier position or in a side-applied carrier position. In the rim-applied carrier position, the carrier stock engages the containers near the upper rims. In the side-applied carrier position, the carrier stock engages the containers along the side walls.

BACKGROUND OF THE INVENTION

A machine for applying carrier stock to substantially identical containers, such as beverage cans, of the type noted above, is exemplified in Braun U.S. Pat. No. 4,250,682. The carrier stock applied by such a machine is of a type made, as by die cutting, from a single sheet of resilient polymeric material, such as low density polyethylene, so as to have band segments defining container-receiving apertures in longitudinal rows.

As exemplified in the Braun patent noted above, the machine comprises a conveyor for conveying the containers longitudinally, in longitudinal rows. Moreover, the machine comprises a wheel assembly rotatable on a transverse axis. The wheel assembly includes a first wheel and a second wheel spaced transversely from the first wheel. The first and second wheels have jaws in transversely opposed pairs, each pair including a first jaw mounted to the first wheel in a fixed position and a second jaw mounted to the second wheel so as to be transversely movable toward and away from the first jaw of such pair. The jaws are used for receiving the carrier stock, stretching the carrier stock transversely as the second jaws are moved away from the first jaws, and moving the carrier stock downwardly past the upper rims of the containers as the wheel assembly is rotated and the containers are conveyed past the rotating assembly.

After the carrier stock has been applied to the containers, the carrier stock is severed transversely into individual carriers, each carrying a small number of the containers (e.g., six containers) in a rectangular array. Commonly, the rectangular array has two longitudinal rows and three transverse ranks. The rectangular array may have a different arrangement, such as three longitudinal rows and two transverse ranks.

As illustrated and described in the Braun patent noted above, the machine is used to apply the carrier stock to the containers in a rim-applied carrier position, in which the carrier stock engages the containers near the upper rims. Also, generally similar machines are known for applying carrier stock to such containers in a side-applied carrier position, in which the carrier stock engages the containers along the side walls.

Such machines for applying carrier stock in a rim-applied carrier position and such machines for applying carrier stock in a side-applied carrier position are available commercially from ITW Hi-Cone (a division of Illinois Tool Works Inc.) of Itasca, Ill., under its "Hi-Cone" trademark.

A need has arisen, to which this invention is addressed, for a machine capable of applying carrier stock to substantially identical containers, such as beverage cans, selectively in a rim-applied carrier position or in a side-applied carrier position.

SUMMARY OF THE INVENTION

This invention provides an improved machine for applying carrier stock of the type noted above to substantially identical containers of the type noted above. The improved machine comprises means for conveying the containers longitudinally, in longitudinal rows, and means for applying the carrier stock to the containers by receiving the carrier stock, stretching the carrier stock transversely, and moving the carrier stock downwardly past the upper rims of the containers as the containers are conveyed. According to this invention, the improved machine further comprises means, which may include a fastener coacting with a slot, for adjusting the conveying and applying means so as to enable the applying means to apply the carrier stock to the containers in a selected one of two positions, namely a rim-applied carrier position, in which the carrier stock engages the containers near the upper rims, and a side-applied carrier position, in which the carrier stock engages the containers along the side walls.

Preferably, the applying means comprises a wheel assembly rotatable on a transverse axis. The wheel assembly includes a first wheel and a second wheel spaced transversely from the first wheel. The first and second wheels have jaws in transversely opposed pairs, each pair including a first jaw mounted to the first wheel in a fixed position and a second jaw mounted to the second wheel so as to be transversely movable toward and away from the first jaw of such pair. The jaws constitute means for receiving the carrier stock, stretching the carrier stock transversely as the second jaws are moved away from the first jaws, and moving the carrier stock downwardly past the upper rims of the containers as the wheel assembly is rotated and the containers are conveyed past the rotating assembly.

This invention contemplates that, if the applying means comprises the wheel assembly noted above, the adjusting means may comprise two longitudinal rails, a carriage mounting the wheel assembly, and rollers mounted to the carriage and engaged with the longitudinal rails so as to enable the carriage and the wheel assembly to be longitudinally moved along the longitudinal rails. Moreover, if the machine further comprises a table supporting the conveying means and a base underlying the table, the adjusting means may further comprise spacers insertable between the table and the base.

This invention further contemplates that, in the wheel assembly noted above, the first and second jaws may be adjustable transversely over a limited range of fixed positions relative to the first and second wheels respectively. Thus, the jaws may be adjustable transversely between an inner, fixed position, in which the jaws are positionable near the upper rims of the containers of the nearer of the longitudinal rows as the containers of such nearer row are conveyed past the wheel, and an outer, fixed position, in which the jaws are positionable near the side walls of the containers of such nearer row as the containers of such nearer row are conveyed past the wheel.

These and other objects, features, and advantages of this invention are evident from the following description of a preferred embodiment of this invention with reference to the accompanying drawings.

BRIEF DESCRIPTION OF THE DRAWINGS

FIG. 6 is a similar detail of a representative one of the transversely adjustable jaws, portions of one wheel of the wheel assembly, and associated means for adjusting the transversely adjustable jaws.

FIG. 7 is a fragmentary, perspective detail of a mechanism for effecting vertical adjustments of a conveyor, which is included in the machine shown in the views noted above.

DETAILED DESCRIPTION OF PREFERRED EMBODIMENT

Figure 3:
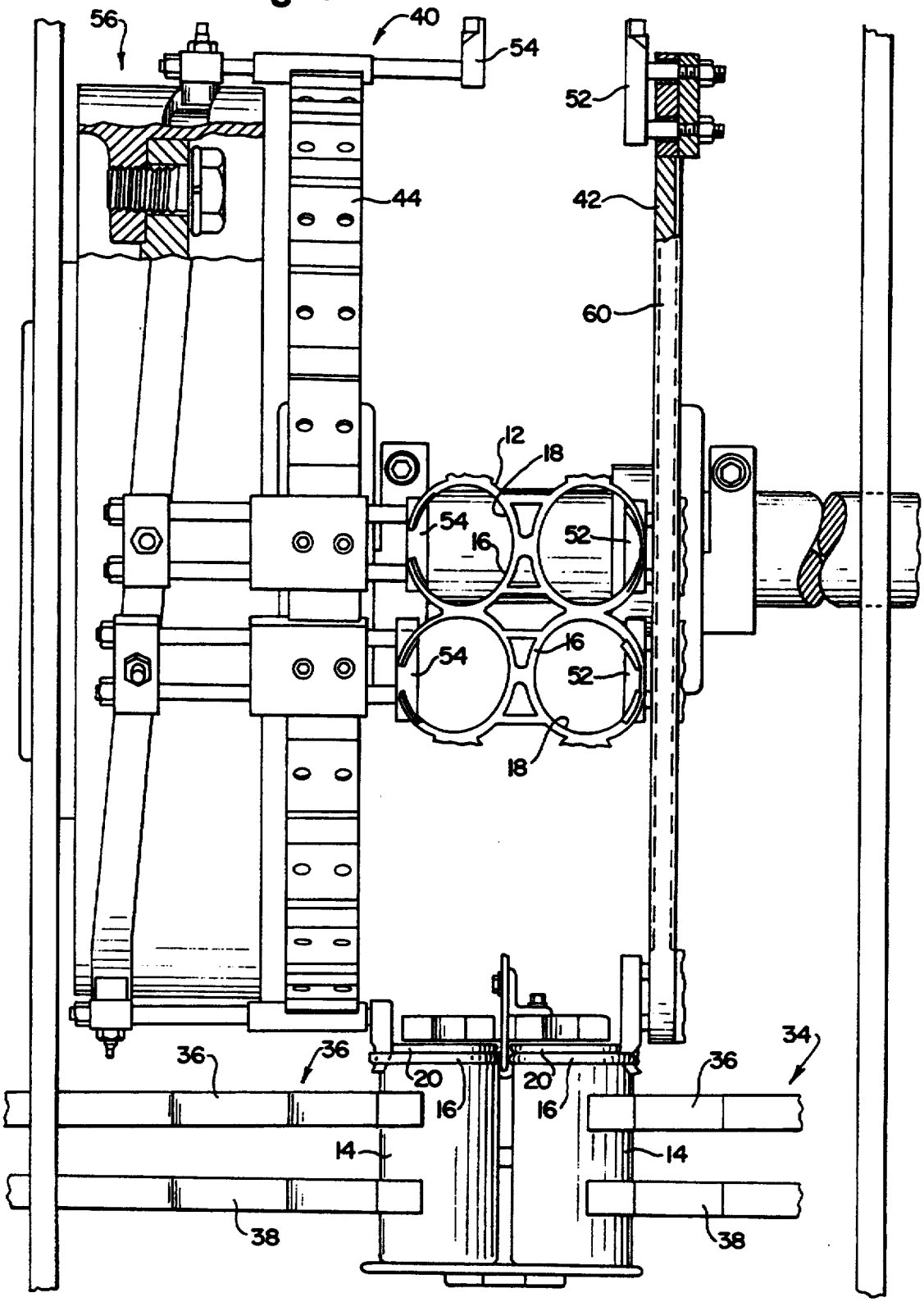
FIG. 3 is an enlarged, fragmentary, elevational view of one end of the wheel assembly and other elements of the machine shown in FIGS. 1 and 2. The wheel assembly is shown in a simplified form omitting most of numerous pairs of opposed jaws, which include transversely adjustable jaws.
Figure 4:
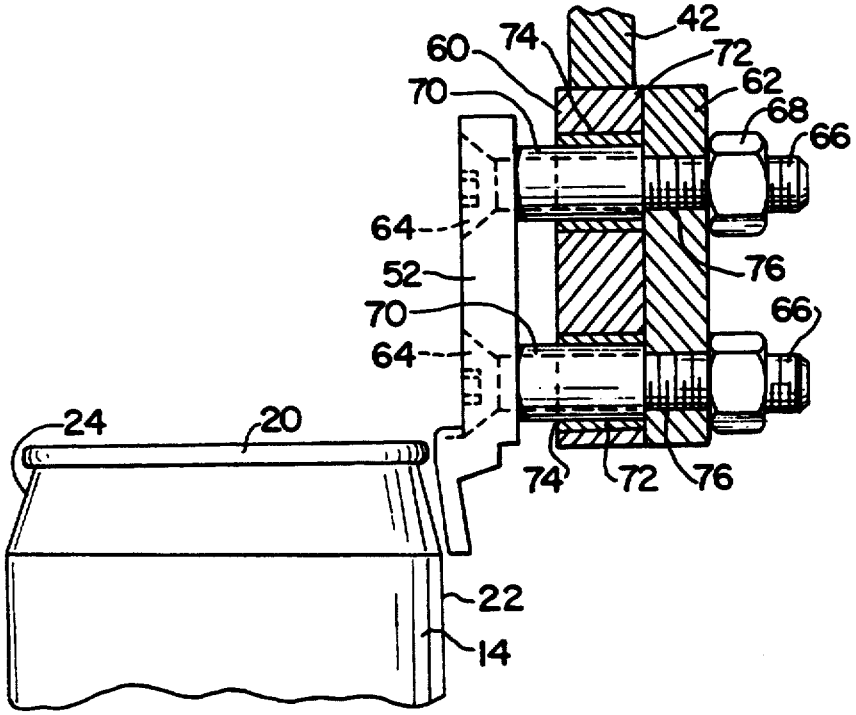
FIGS. 4 and 5 are further enlarged, fragmentary details of a representative container, portions of one wheel of the wheel assembly, and one of the transversely adjustable jaws, respectively as adjusted (see FIG. 4) for applying carrier stock to the containers in a rim-applied carrier position and as adjusted (see FIG. 5) for applying carrier stock in the side-applied carrier position.
Figure 5:
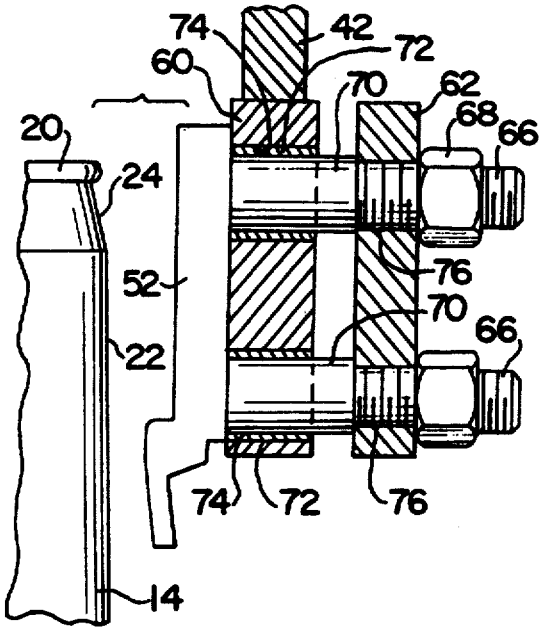

As shown in the drawings, a machine 10 for applying carrier stock 12 (see FIG. 3) to substantial identical containers 14 constitutes a preferred embodiment of this invention. As shown fragmentarily in FIG. 3, the carrier stock 12 is of a well known type made, as by die-cutting, from a single sheet of resilient polymeric material, such as low density polyethylene, so as to have band segments 16 defining container-receiving apertures 18 in two longitudinal rows. As shown in FIGS. 3, 4, and 5, each container 14 is a beverage can, such as a soft drink or beer can, of a well known type having an upper rim 20 of a given diameter, a side wall 22 of a larger diameter, and a frusto-conical neck 24 between the upper rim 20 and the side wall 22. The upper rim 20 is known also as a chime. The machine 10 can be selectively used for applying the carrier stock 12 selectively to the containers 14 in a rim-applied carrier position, in which the carrier stock 12 engages the containers 14 near the upper rims 20, or in a side-applied carrier position, in which the carrier stock 12 engages the containers 14 along the side walls 22.

Except as illustrated and described herein, the machine 10 is similar to the machine illustrated and described in Braun U.S. Pat. No. 4,250,682, the disclosure of which is incorporated herein by reference. Thus, the machine 10 comprises an input conveyor 30 for conveying the containers 14 longitudinally into a work station of the machine 10, in two longitudinal rows, and an output conveyor 32 for conveying the containers 14 longitudinally from the work station, after the carrier stock 12 has been applied. Also, on each side, the machine 10 comprises a conveyor 34 including an upper star wheel 36 and a lower star wheel 38 for conveying the containers 14 between the input and output conveyors 30, 32, and for locating the containers 14 for accurate application of the carrier stock 12. The input and output conveyors 30, 32, and the star wheel conveyors 34 are similar to the input, output, and star wheel conveyors of generally similar machines known and used heretofore, as exemplified in the Braun patent noted above.

The machine 10 comprises a wheel assembly 40 for applying the carrier stock 12 to the containers in the work station by receiving the carrier stock 12, stretching the carrier stock 12 transversely, and moving the carrier stock 12 downwardly past the upper rims 20 of the containers 14.

According to this invention, the machine 10 further comprises means to be later described for adjusting relative positions of the input and output conveyors 30, 32, and the wheel assembly 40 so as to enable the wheel assembly 40 to apply the carrier stock 12 to the containers 14 in a selected one of two positions, namely the rim-applied carrier position noted above and the side-applied carrier position noted above, as the containers 14 are being conveyed past the wheel assembly 40 by the star wheel conveyors 34.

The wheel assembly 40, which may be also called a jaw drum, comprises two spider wheels, namely a first wheel 42 and a second wheel 44, which is spaced transversely from the first wheel 42. The spider wheels 40, 42, are rotatable about a transverse axis. As suggested by dashed lines in FIG. 2, a guide system 46, which is similar to the guide system mentioned in the Braun patent noted above with reference to Schlueter et al. U.S. Pat. No. 3,775,935, is provided for guiding the carrier stock 12 onto the wheel assembly 40 from a feed system 48 of a known type.

The wheel assembly 40 comprises multiple pairs of transversely opposed jaws. Each pair included a first jaw 52, which is mounted to the first wheel 42 in a fixed position, and a second jaw 54, which is mounted to the second wheel 44 so as to be transversely movable toward and away from the first jaw 52 of such pair. The jaws 52, 54, constitute means for receiving the carrier stock 12, stretching the carrier stock 12 transversely as the second jaws 54 are moved away from the first jaws 52, and moving the carrier stock 12 downwardly past the upper rims 20 of the containers 14 as the wheel assembly 40 is rotated and the containers 14 are conveyed past the rotating assembly 40 by the input and output conveyors 30, 32. Known means (not shown) are provided for rotating the first and second wheels 42, 44, in timed relation to movement of the containers 14 being conveyed into and from the work station. A cam-driven system 56, which is similar to the cam-driven system illustrated and described in the Braun patent noted above, is provided for moving the second jaws 54 toward and away from the first jaws 52 in timed relation to rotation of the first and second wheels 42, 44.

Figure 12:
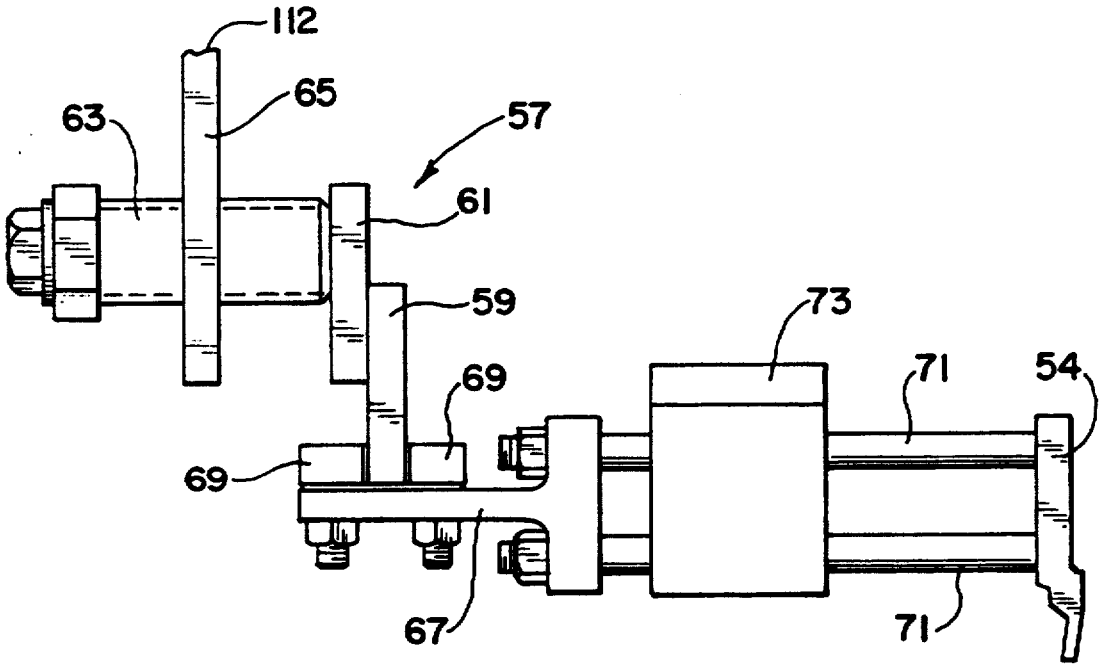
FIG. 12 is a simplified view of a means for adjusting the movable jaws.

Alternatively, as illustrated in FIG. 12, the cam-driven system 56 may include a jawdrum cam assembly 57 which connects the machine frame 112 to the second jaws 54. In this embodiment, the jawdrum cam assembly 57 includes a jawdrum cam 59 mounted on a cam plate 61. The camplate 61, in turn, is attached to a jacking screw 63 which is fixedly mounted on a side plate 65. The jacking screw 63, is used to adjust the jawdrum cam 59 inwardly or outwardly to account for different sizes of containers 14. The side plate 65 is rigidly attached to the machine frame 112. The jawdrum cam 59 is also attached to a flange 67 by rollers 69. Flange 67 is connected to the second jaws 54 by rods 71. A bearing block 73 is mounted on rods 71 and attached to the second wheel 44 by suitable means. In operation, the rollers 69 contour the shape of the jawdrum cam 59. This contour causes the jaws 54 to retract or extend depending on the shape of the jawdrum cam surface.

Figure 1:
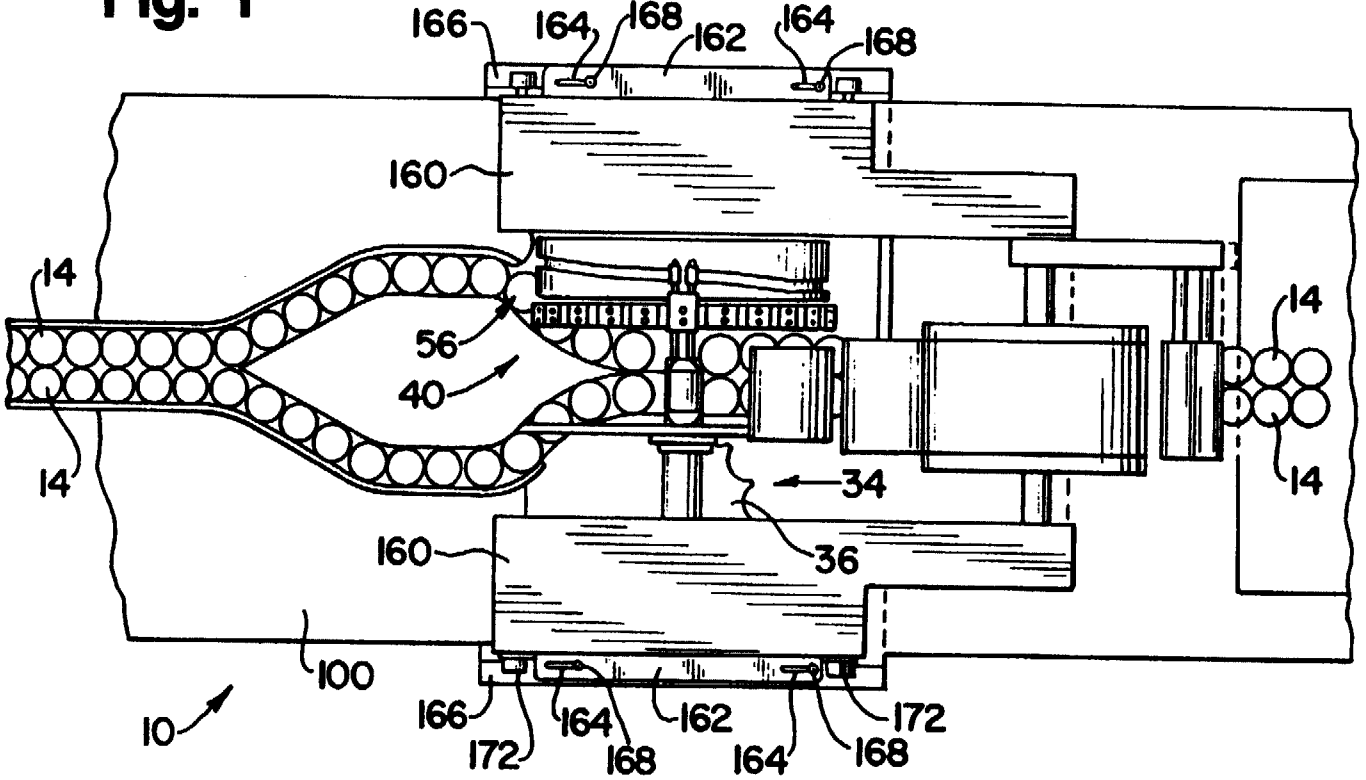
FIG. 1 is a plan view of the top of a machine embodying this invention for applying carrier stock to containers, such as beverage cans, in a rim-applied or side-applied carrier position. Some elements are shown in simplified forms.

As illustrated in FIG. 1 and described above, the wheel assembly 40 is similar to the wheel assembly illustrated and described in the Braun patent noted above. However, the wheel assembly 40 differs from the wheel assembly illustrated and described therein because, in the wheel assembly 40, the jaws 52 and 54 are adjustable transversely. Specifically, the jaws 52 and 54 are adjustable between an innermost, fixed position relative to for example in the case of jaw 52, the first wheel 42 and an outermost, fixed position relative thereto. In the innermost position, the first jaws 52 are positioned near the upper rims 20 of the containers 14 of a nearer of the longitudinal rows of the containers 14 as the containers 14 of the nearer row are conveyed past the first wheel 42, in a suitable position for applying the carrier stock 12 in the rim-applied carrier position. In the outermost position, the first jaws 52 are positioned near the side walls 22 of the containers 14 of the nearer row as the containers 14 of the nearer row are conveyed past the first wheel 42, in a suitable position for applying the carrier stock 12 in the side-applied carrier position. The first jaws 52 can be similarly adjusted to fixed positions between the innermost and outermost positions so as to accommodate variations in the diameters of the rims and side walls of the containers 14. It is to be understood that the description of the adjustability of jaws 52 applies to jaws 54 also.

As shown in FIGS. 4 and 5, the first wheel 42 has an outer rim 60 mounting the first jaws 52. An annular plate 62 is mounted to the first wheel 42, in a manner described below, so as to be conjointly rotatable with the first wheel 42 and so as to be transversely adjustable between a position wherein the annular plate 62 engages the wheel rim 60, as shown in FIG. 4, and a position wherein the annular plate 62 is displaced transversely from the wheel rim 60, as shown in FIG. 5.

Each jaw 52 is mounted fixedly to an annular plate 62, via two machine screws 64, each having a threaded shank 66 receiving a threaded nut 68 with a sleeve 70 interposed between such jaw 52 and the annular plate 62. Each sleeve 70 extends slidably through a tubular bushing 72, which is pressed into a bore 74 in the wheel rim 60. Each threaded shank 66 extends beyond the associated sleeve 70 and through a bore 76 in the annular plate 62. The associated nut 68 is threaded onto such threaded shank 66 so as to secure the annular plate 62 between the associated nut 68 and the associated sleeve 70.

Figure 10:
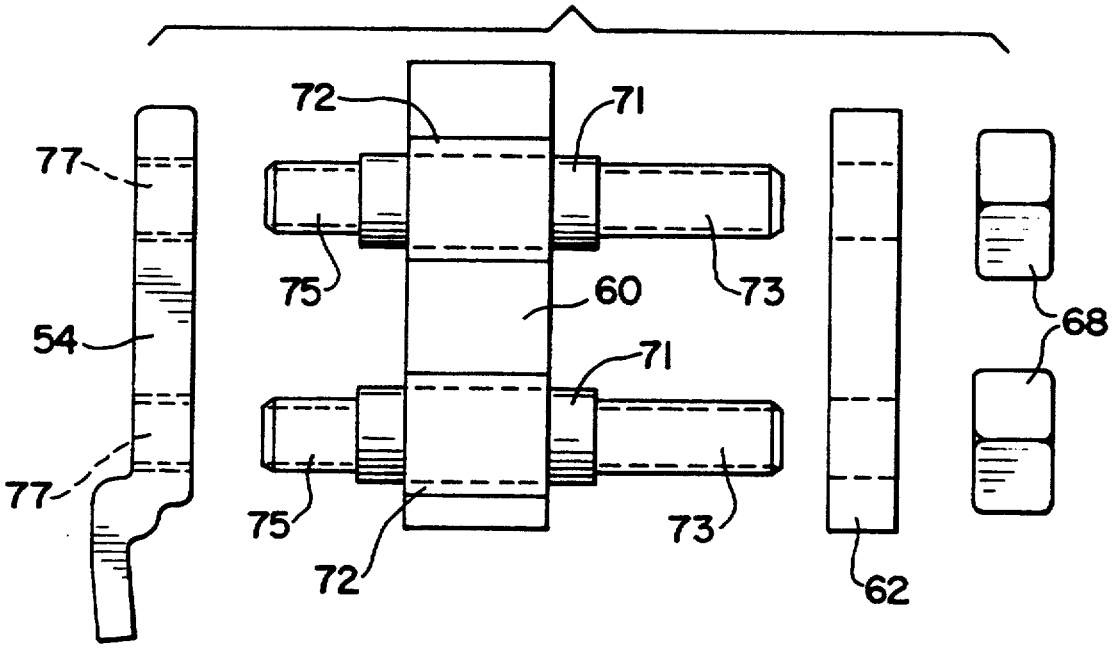
FIG. 10 is an alternate embodiment shown in an exploded, simplified view of an adjustment assembly similar to the means for adjusting the jaws as shown in FIG. 4.

Alternatively, as illustrated in FIG. 10, each sleeve 70 may be replaced with a connecting rod 71 with threaded ends 73, 75. The threaded end 73 is threaded into a threaded socket 77 in the jaw 52. The connecting rod 71 is fixedly mounted within the bushing 72. When the annular plate 62 is secured on the threaded end 75, the annular plate 62 abuts a shoulder 79 of the connecting rod 71.

As shown in FIG. 6, the annular plate 62 is mounted to the first wheel 42 via a plurality of jack screws 80 spaced regularly around the annular plate 62 and the first wheel 42, e.g., six jack screws 80. Each jack screw 80 has a head 82 bearing against the wheel rim 60 and a threaded shank 84 threaded through a threaded bore 86 in the wheel rim 60. The threaded shank 84 is longer than the threaded bore 86. Each jack screw 80 is associated with a locking screw 90 having a head 92 and a threaded shank 94. When the locking screw 90 is tightened, the head 92 bears against the annular plate 62 and the threaded shank 94 extends through a bore 96 in the annular plate 62 and is threaded into a threaded socket 98 in the threaded shank 84 of such jack screw 80. The bore 96 is smaller than the threaded shank 84 of such jack screw 80.

Thus, when the locking screw 90 is tightened, the annular plate 62 is drawn against the threaded shank 84 so as to prevent such jack screw 80 from rotating. However, when the locking screw 90 is loosened sufficiently, such jack screw 90 is rotatable so as to adjust the annular plate 62 and the first jaws 52 mounted fixedly to the annular plate 62 transversely toward or away from the wheel rim 60.

Figure 11:
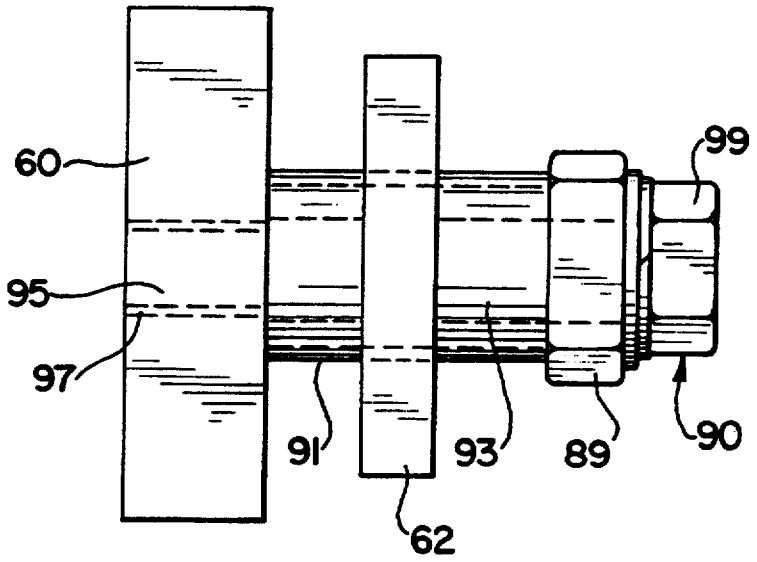
FIG. 11 is a simplified view of an alternate embodiment of the means for adjusting the jaws illustrated in FIG. 6.

In an alternate embodiment, as illustrated in FIG. 11, a jacking screw 91 is connected to and bears against the wheel rim 60 by action of the locking screw 90. The jacking screw 91 includes a shank 93 with a head 95 at an end 97 thereof. The end 99 opposite to the head 95 bears against the wheel rim 60. The shank 93 and head 95 include an unthreaded bore 101 which extends axially through the length of the jacking screw 91. The exterior of the shank 93 is threaded and is threaded through a threaded bore 103 in the plate 62 so as to allow the plate 62 to translate along the length of the shank 93 thereby moving the first jaw 52 as described hereinbelow.

The locking screw 90 is housed within the unthreaded bore 101 of the jacking screw 91 and is attached to the wheel rim 60. The locking screw 90 includes a head 105 and a shank portion 107 with a threaded end portion 109. In a locked condition, the shank portion 107 extends through the unthreaded bore 101 of the jacking screw 91 and the threaded end portion 109 is threaded into a threaded socket 111 within the wheel rim 60. The diameter of the bore 101 of the jacking screw 91 is sufficiently larger than the diameter of the shank 107, 109 of the locking screw 90 to allow the locking screw 90 to rotate freely therein for purposes which will be explained below.

In a locked condition, the head 105 of the locking screw 90 abuts against washers 113 which, in turn, bear against the head 95 of the jacking screw 91. When locked, the end 99 of the jacking screw 91 bears against the wheel rim 60. To move the annular plate 62, thereby moving the first jaws 54, the locking screw 90 is first loosened by rotation which causes part of the threaded end 109 of the locking screw 90 to move out of socket 111 and into the bore 101 of the jacking screw 91. Once the locking screw 90 has been loosened, the jacking screw 91 is free to rotate. During rotation of the jacking screw 91, the end 99 continually bears against the wheel rim 60. When the jacking screw 91 is rotated, the annular plate 62 translates along the length of the threaded shank 93 of the jacking screw 91 thereby moving the first jaws 54 transversely toward or away from the wheel rim 60. When the first jaws 54 have been adjusted to the proper position, the locking screw 90 is rotated into the locked position as described hereinabove.

As shown in FIG. 4, the first jaws 52 can be thus adjusted transversely away from the wheel rim 60, into the inner, fixed position, so as to position the first jaws 52 for applying the carrier stock 12 in the rim-applied carrier position. As shown in FIG. 5, the first jaws 52 can be thus adjusted transversely away from the wheel rim 60, into the outer, fixed position, so as to position the first jaws 52 for applying the carrier stock 12 in the side-applied carrier position.

As shown in FIG. 7, the input and output conveyors 30, 32, and the star wheel conveyors 34 can be vertically adjusted over a limited range of vertical adjustment. The conveyors 32, 34, 36, are supported by a table 100 (see FIGS. 1 and 2) having a lower frame 102. A base 110 (see FIG. 2) having an upper frame 112 underlies the table frame 102. At each of several locations on each side, a lever 120 is mounted pivotally to the base frame 112, via a pivot pin 122, and is operable manually to raise and lower the table frame 102 relative to the base frame 112. When the table frame 102 is in an upper position, as shown in FIG. 9, the rim of the containers 14 is positioned in such a manner that the carrier stock 12 is applied in a side-applied carrier position. The distance from the conveyors to the jaws 52, 54 in this side-applied condition is shown by the line M. In a lower position, the carrier stock 12 to be applied in the rim-applied carrier position to the containers 14 and the distance between the conveyor to the jaws in this rim-applied condition is shown by the line L in FIG. 8.

Near each lever 120, elongate, generally rectangular spacers 130, which have varying thicknesses to accommodate containers of different heights, are stacked on a post 132 extending upwardly from the base frame 112, through holes (not shown) in the spacers 130. Thus, one or more of the spacers 130 can be manually rotated on the post 132 into and from a home orientation, in which the spacers 130 are shown in FIG. 7. Also, one or more of the spacers 130 can be manually elevated on the post 132 to a position or positions above the table frame 102, when rotated from the home orientation sufficiently to clear the table frame 102. One or more spacers 130 can be thus interposed between the base frame 112 and the table frame 102 so as to elevate the table 100 and the conveyors supported on the tables. If no spacers or a few spacers 130 are placed above the table frame 102, the carrier stock 12 will be applied near the upper rim 20 of the container 14. As more spacers 130 are moved to a position above the table frame 102, the carrier stock 12 will be placed in a lower position on the container 14. A retainer 136 is mounted on the post 132, at an elevation sufficient to accommodate every spacer 130 above and below the table frame 102, so as to retain the spacers 130 thereon.

Each spacer 130 has a recess 138 adapted to accommodate a post 142 extending upwardly from the base frame 112, through a hole 144 in the table frame 102, whether or not such spacer 130 is elevated on the post 132. The post 142 has a threaded end (not shown) mounting a knurled knob 150 having a threaded socket (not shown) receiving the threaded end. The knurled knob 150, which spans the recess 138 of the uppermost spacer 130 when the uppermost spacer 130 is in the home orientation, can be manually loosened so as to permit the spacers 130 to be manually rotated into and from the home orientation. When each spacer 130 above or below the table frame 102 has been rotated to the home orientation, as shown in FIG. 7, the knurled knob 150 can be manually tightened against the uppermost spacer 130, or against the table frame 102, so as to secure the spacers 130 to the table frame 102 and to the base frame 112. While the preferred embodiment of adjusting the table height has been disclosed hereinabove, it is to be understood that alternate means for adjusting the table height may be used without departing from the scope of this invention.

Figure 8:
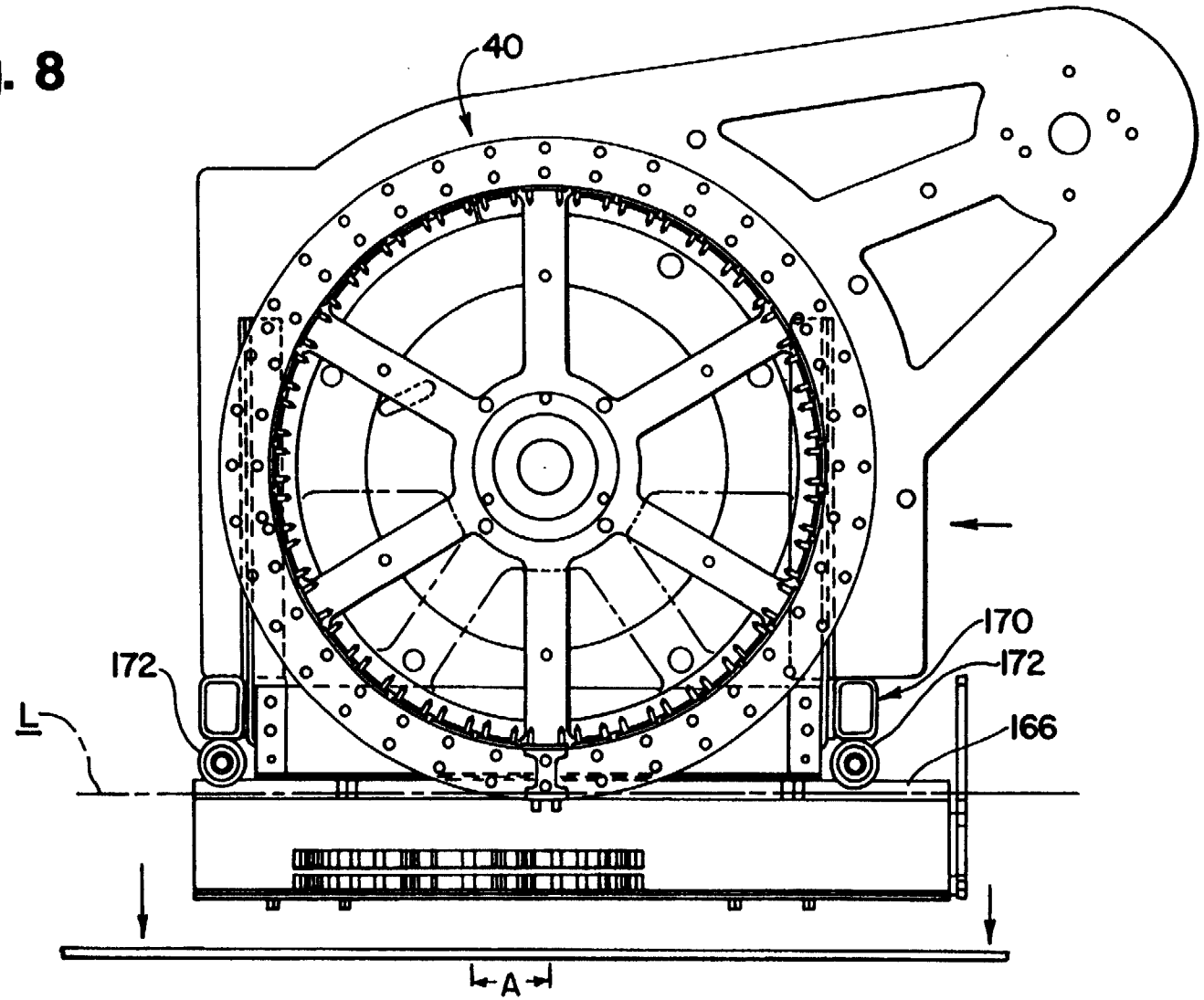
FIG. 8 is a front elevational view of the wheel mechanism and a star wheel conveyor on one side, as adjusted for applying the carrier stock in a rim-applied carrier position.
Figure 9:
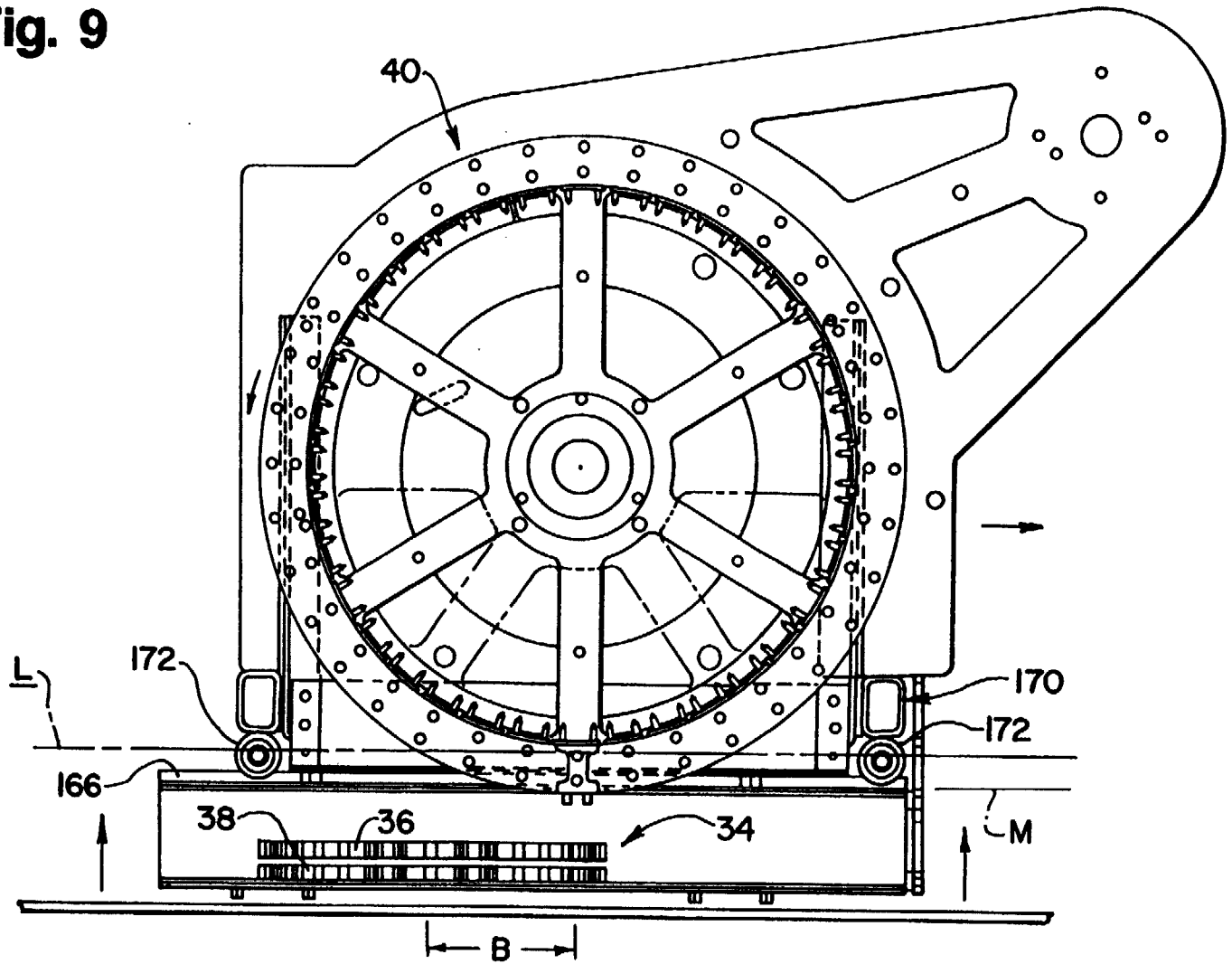
FIG. 9 is a similar view of the wheel mechanism and the star wheel conveyor shown in FIG. 8, as adjusted for applying the carrier stock in a side-applied carrier position.

As shown in FIGS. 1, 2, 8, and 9, the wheel assembly 40 and the cam-driven system 56 can be longitudinally adjusted over a limited range of longitudinal adjustment. In FIGS. 8 and 9, lines L and M, as described hereinabove, represent the level of the conveyor table relative to the jaws 52, 54 and the level of the carrier stock 12 on the containers 14, which are not shown therein. In FIG. 8, the star wheel conveyors 34 and the input and output conveyors (which are not shown therein) are elevated to a maximum elevation (via the spacers 130 interposed between the base frame 112 and the table frame 102 as described above) and the wheel assembly 40 is adjusted to a forward limit of the limited range of longitudinal adjustment relative to the starwheel 34, whereby the carrier stock (which is not shown therein) may be rim-applied by the wheel assembly 40. The distance between the starwheel 34 centerline and wheel assembly 40 centerline in this rim-applied mode is shown by the distance A in FIG. 8. In FIG. 9, the same conveyors are not elevated and the wheel assembly 40 is adjusted to a rearward limit of the limited range of longitudinal adjustment relative to the starwheel 34, whereby the carrier stock (which is not shown therein) may be side-applied by the wheel assembly 40. The distance between the starwheel 34 centerline and wheel assembly 40 centerline in this side-applied mode is shown as the distance B in FIG. 9.

Figure 2:
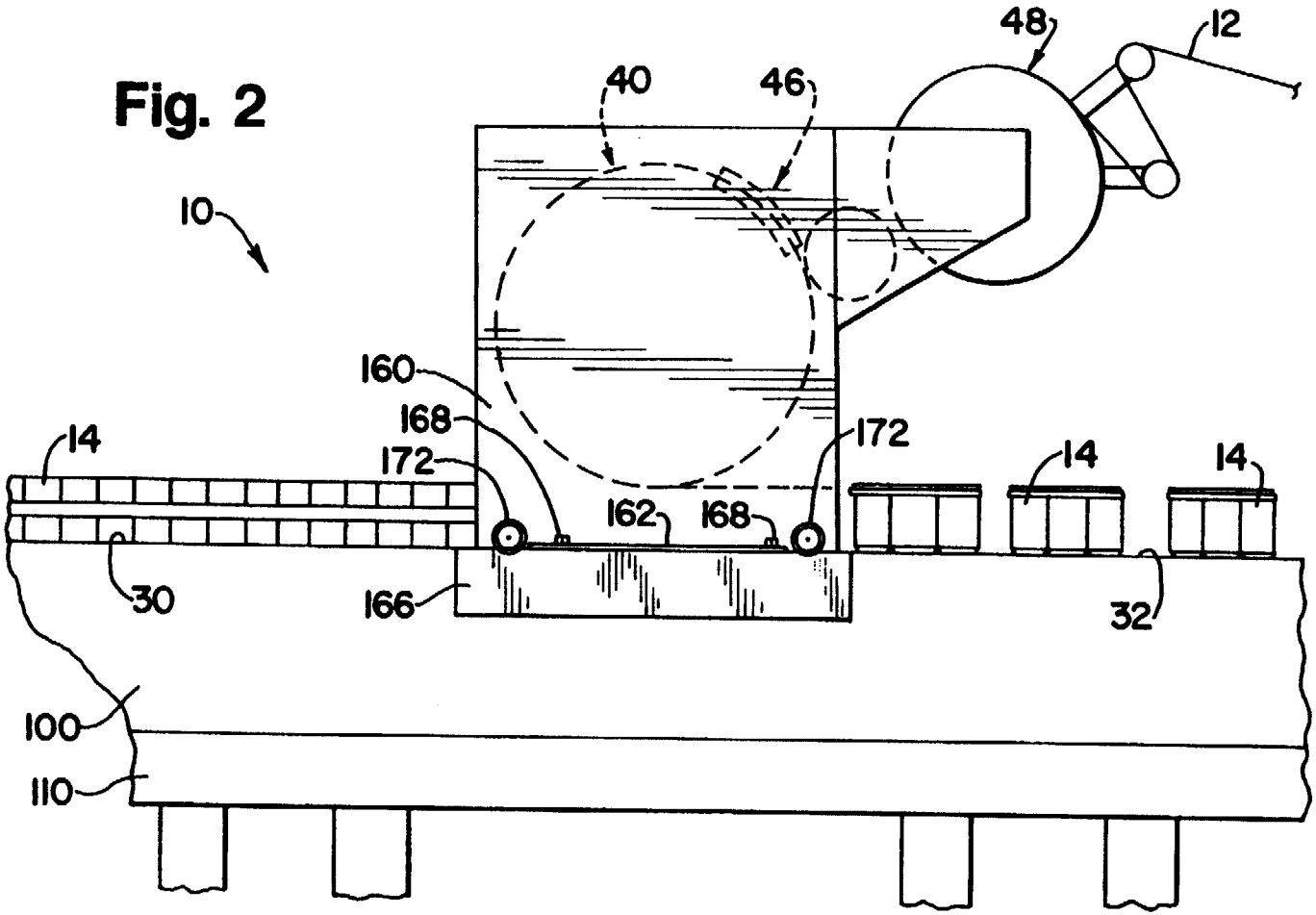
FIG. 2 is an elevational view of one side of the machine shown in FIG. 1. Some elements again are shown in simplified forms. A wheel assembly is shown behind other structure, in dashed lines.

As shown in FIGS. 1 and 2, the wheel assembly 40 and the cam-driven system 56 are shrouded on each side by an enclosure 160 having a lower flange 162 having two elongate slots 164. The slots 164 of the respective flanges 162 define the limited range of longitudinal adjustment described above. Two longitudinal rails 166 are secured suitably to the base 110. Each of the lower flanges 162 overlies one of the longitudinal rails 166. Fasteners 168 having threaded stems (not shown) extending through the slots 164, into threaded apertures (not shown) in the rails 166 are used to secure the enclosures 160 to the rails 166 and to locate the wheel assembly 40 relative to the rails 166. Two such fasteners 168 are used on each side. As shown in FIGS. 8 and 9, the wheel assembly 40 and associated elements are mounted operatively on a carriage 170 having flanged rollers 172, which ride on the rails 166. Two such rollers 172 are used on each side. When the fasteners 168 are loosened, the carriage 170, the wheel assembly 40, and associated elements can be longitudinally adjusted within the limited range defined by the slots 164. The rollers 172 facilitate longitudinal adjustment of the carriage 170, the wheel assembly 40, and associated elements along the rails 166.

When it is desired to arrange the machine 10 to apply the carrier stock 12 to the containers 14 in the rim-applied carrier position, the jaws 52 and 54 are adjusted transversely to an inner position, such as the innermost position described above as shown in FIG. 4. When it is desired to arrange the machine 10 to apply the carrier stock 12 to the containers 14 in the side-applied carrier position, the jaws 52 and 54 are adjusted transversely to an outer position, such as the outermost position described above as shown in FIG. 5.

In either instance, a suitable number of the spacers 130 are interposed between the table frame 102 and the base frame 112 so as to position the table 100, the input and output conveyors 30, 32, and the star wheel conveyors 34 at suitable elevations, as described above. Moreover, in either instance, the carriage 170, the enclosures 160, the wheel assembly 40, and the cam-driven system 56 are adjusted longitudinally to suitable positions along the longitudinal rails 166, as described above.

Various modifications may be made in the preferred embodiment described above without departing from the scope and spirit of this invention.

We claim:

1. A machine for applying carrier stock to substantially identical containers in a rectangular array, the carrier stock being of a type made from resilient polymeric material with band segments defining container-receiving apertures in a rectangular array, each container being of a type having an upper rim of a given diameter and a side wall of a larger diameter, the machine comprising (a) means for conveying the containers in a horizontal, longitudinal direction of movement, in longitudinal rows, (b) means for applying the carrier stock to the containers by receiving the carrier stock, stretching the carrier stock transversely, at right angles to the direction of movement of the containers, and moving the carrier stock downwardly past the upper rims of the containers as the containers are conveyed, and (c) means for adjusting relative positions of the conveying and applying means so as to enable the applying means to apply the carrier stock to the containers in a selected one of two positions, namely a rim-applied carrier position, in which the carrier stock engages the containers near the upper rims, and a side-applied carrier position, in which the carrier stock engages the containers along the side walls, wherein the applying means comprises a wheel assembly rotatable on a transverse axis, which extends at right angles to the direction of movement of the containers, the wheel assembly including a first wheel and a second wheel spaced along the transverse axis from the first wheel, the first and second wheels having jaws in transversely opposed pairs, the jaws constituting means for receiving the carrier stock, stretching the carrier stock transversely as the second jaws are moved away from the first jaws, and moving the carrier stock downwardly past the upper rims of the containers as the wheel assembly is rotated and the containers are conveyed past the rotating assembly, and wherein the adjusting means comprises means for moving the wheel assembly longitudinally of the direction of movement of the containers.

2. The machine of claim 1 wherein each pair of jaws includes a first jaw mounted to the first wheel in a fixed position and a second jaw mounted to the second wheel so as to be transversely movable toward and away from the first jaw of such pair.

3. The machine of claim 2 further comprising a table supporting the conveying means and a base underlying the table and wherein the adjusting means further comprises spacers insertable between the table and the base.

4. A machine for applying carrier stock to substantially identical containers in a rectangular array, the carrier stock being of a type made from resilient polymeric material with band segments defining container-receiving apertures in a rectangular array, each container being of a type having an upper rim of a given diameter and a side wall of a larger diameter, the machine comprising (a) means for conveying the containers in a horizontal, longitudinal direction of movement, in longitudinal rows, (b) means for applying the carrier stock to the containers by receiving the carrier stock, stretching the carrier stock transversely, at right angles to the direction of movement of the containers, and moving the carrier stock downwardly past the upper rims of the containers as the containers are conveyed, and (c) means for adjusting relative positions of the conveying and applying means so as to enable the applying means to apply the carrier stock to the containers in a selected one of two positions, namely a rim-applied carrier position, in which the carrier stock engages the containers near the upper rims, and a side-applied carrier position, in which the carrier stock engages the containers along the side walls, wherein the applying means comprises a wheel assembly rotatable on a transverse axis, which extends at right angles to the direction of movement of the containers, the wheel assembly including a first wheel and a second wheel spaced along the transverse axis from the first wheel, the first and second wheels having jaws in opposed pairs, the jaws constituting means for receiving the carrier stock, stretching the carrier stock transversely, at right angles to the direction of movement of the containers, as the jaws of each pair are moved relatively away from each other, and moving the carrier stock downwardly past the upper rims of the containers as the wheel assembly is rotated and the containers are conveyed past the rotating assembly, and said adjusting means also adjusting the transversely, at right angles to the direction of movement of the containers, over a limited range of fixed positions relative to the respective wheels.

5. The machine of claim 1 wherein each pair of jaws includes a first jaw mounted to the first wheel in a fixed position and a second jaw mounted to the second wheel so as to be movable toward and away from the first jaw of such pair.

6. The machine of claim 1 wherein the means for adjusting relative positions of the conveying and applying means includes a fastener coacting with a slot for adjustably securing the conveying and applying means relative to each other.

7. The machine of claim 1 wherein the means for moving the wheel assembly longitudinally of the direction of movement of the containers comprises two longitudinal rails, a carriage mounting the wheel assembly, and rollers mounted to the carriage and engaged with the longitudinal rails so as to enable the carriage and the wheel assembly to be longitudinally moved along the longitudinal rails.

8. The machine of claim 7 wherein the longitudinal rows of the containers include a row nearer the first wheel and wherein the first jaws are adjustable between an inner, fixed position, in which the first jaws are positionable near the upper rims of the containers of the nearer row as the containers of the nearer row are conveyed past the first wheel, and an outer, fixed position, in which the first jaws are positionable near the side walls of the containers of the nearer row as the containers of the nearer row are conveyed past the first wheel.

9. The machine of claim 5 wherein the longitudinal rows of the containers include a row nearer the first wheel and wherein the first jaws are adjustable transversely between an inner, fixed position, in which the first jaws are positionable near the upper rims of the containers of the nearer row as the containers of the nearer row are conveyed past the first wheel, and an outer, fixed position, in which the first jaws are positionable near the side walls of the containers of the nearer row as the containers of the nearer row are conveyed past the first wheel.

* * * * *

UNITED STATES PATENT AND TRADEMARK OFFICE

CERTIFICATE OF CORRECTION

PATENT NO. : 5,383,321

DATED : January 24, 1995

INVENTOR(S) : Krogman et al.

It is certified that error appears in the above-indentified patent and that said Letters Patent is hereby corrected as shown below:

Column 10:
Claim 4, line 60, after "the", --jaws-- should be inserted;

Signed and Sealed this

Nineteenth Day of September, 1995

*Attest:*

Bruce Lehman

BRUCE LEHMAN

*Attesting Officer*

*Commissioner of Patents and Trademarks*